US008485319B2

(12) United States Patent
Peacock et al.

(10) Patent No.: US 8,485,319 B2
(45) Date of Patent: Jul. 16, 2013

(54) METHOD AND APPARATUS FOR INSTALLING AN ELEVATOR WITHOUT MACHINE ROOM DURING CONSTRUCTION OF A BUILDING, AND USE OF A HOISTING MACHINE

(75) Inventors: Mark Peacock, Riihimaki (FI); Mikael Kaihola, Oitti (FI); Gert Van Der Meijden, Otterlo (NL); Jos Van Den Heuvel, 'S-Hertogenbosch (NL)

(73) Assignee: Kone Corporation, Helsinki (FI)

( * ) Notice: Subject to any disclaimer, the term of this patent is extended or adjusted under 35 U.S.C. 154(b) by 414 days.

(21) Appl. No.: 12/466,821

(22) Filed: May 15, 2009

(65) Prior Publication Data

US 2009/0223751 A1 Sep. 10, 2009

Related U.S. Application Data

(63) Continuation of application No. PCT/FI2007/000269, filed on Nov. 7, 2007.

(30) Foreign Application Priority Data

Nov. 17, 2006 (FI) ..... 20061017

(51) Int. Cl.
*B66B 9/00* (2006.01)

(52) U.S. Cl.
USPC ..... 187/414

(58) Field of Classification Search
USPC ..... 187/414
See application file for complete search history.

(56) References Cited

U.S. PATENT DOCUMENTS

| | | | | |
|---|---|---|---|---|
| 3,298,462 | A * | 1/1967 | Morris | 187/262 |
| 5,000,292 | A * | 3/1991 | Chapelain et al. | 187/408 |
| 5,033,586 | A | 7/1991 | Richards et al. | |
| 5,583,326 | A * | 12/1996 | Sors | 187/277 |
| 5,899,300 | A * | 5/1999 | Miller et al. | 187/256 |
| 6,006,865 | A * | 12/1999 | Ammon | 187/266 |
| 6,446,763 | B1 * | 9/2002 | Glassey et al. | 187/414 |
| 6,857,508 | B2 * | 2/2005 | Miller et al. | 187/401 |
| 7,537,088 | B2 * | 5/2009 | Spitsbergen | 187/242 |
| 7,635,049 | B2 * | 12/2009 | Van Der Meijden et al. | 187/401 |
| 2005/0224301 | A1 * | 10/2005 | Aulanko et al. | 187/406 |
| 2007/0131636 | A1 * | 6/2007 | Spitsbergen | 212/179 |
| 2007/0256899 | A1 * | 11/2007 | Fanielle et al. | 187/408 |

FOREIGN PATENT DOCUMENTS

| | | | |
|---|---|---|---|
| GB | 2 217 296 | A | 10/1989 |
| JP | 4-191276 | A | 7/1992 |
| JP | 7-97157 | A | 4/1995 |
| JP | 2001-322778 | A * | 11/2001 |

(Continued)

*Primary Examiner* — William A Rivera
*Assistant Examiner* — Michael Riegelman
(74) *Attorney, Agent, or Firm* — Birch, Stewart, Kolasch & Birch, LLP

(57) ABSTRACT

The invention relates to a method and an apparatus for installing an elevator with-out machine room during the construction of a building, said elevator comprising at least a hoisting machine (4) provided with a traction sheave (30) and an elevator car (3) suspended by a set of hoisting ropes (28) and fitted to move along guide rails (2), and in which method at least a temporary machine room (6) movable in the elevator shaft (1) is utilized. At the final stage of installation, the machine room (6) of the elevator provided with a temporary machine room (6) is dismounted and the elevator is converted into an elevator without machine room by placing the hoisting machine (4) that was used in the temporary machine room (6), together with the hoisting ropes (28) on the traction sheave (30), into its final position in the elevator shaft (1).

17 Claims, 7 Drawing Sheets

FOREIGN PATENT DOCUMENTS

Figure 1:
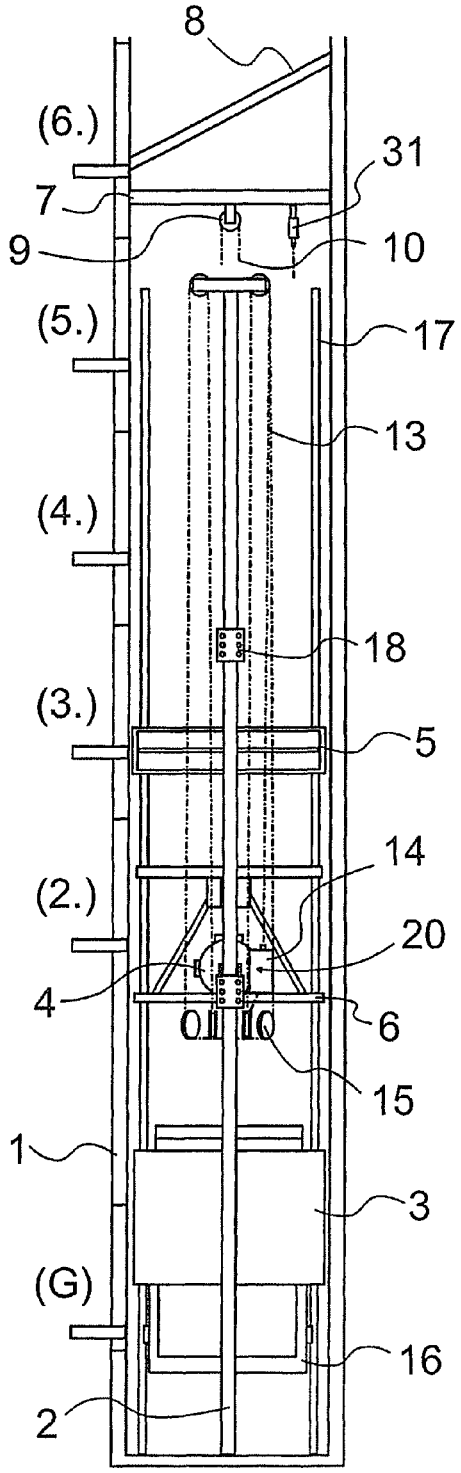

| | | | | |
|---|---|---|---|---|
| KR | 2002-0078342 | A | | 10/2002 |
| WO | WO-00/07923 | A1 | | 2/2000 |
| WO | WO-00/50328 | A2 | | 8/2000 |
| WO | WO-01/44096 | A1 | | 6/2001 |
| WO | WO-2004/050526 | A1 | | 6/2004 |
| WO | 2005/030631 | A | * | 4/2005 |

* cited by examiner

METHOD AND APPARATUS FOR INSTALLING AN ELEVATOR WITHOUT MACHINE ROOM DURING CONSTRUCTION OF A BUILDING, AND USE OF A HOISTING MACHINE

This application is a Continuation of copending PCT International Application No.

PCT/FI2007/000269 filed on Nov. 7, 2007, which designated the United States, and on which priority is claimed under 35 U.S.C. §120. This application also claims priority under 35 U.S.C. §119(a) on patent application No(s). 20061017 filed in Finland on Nov. 17, 2006, the entire contents of each of the above documents is hereby incorporated by reference into the present application.

The present invention relates to a method as defined in the preamble of claim 1 and an apparatus as defined in the preamble of claim 6 for installing and elevator without machine room during the construction of a building and to use of a hoisting machine.

During the construction of tall buildings, there is often a need to use an elevator even before the construction of the building has been completed. Elevators are needed as an aid at the construction stage for many different uses. For example, in construction-time use they are needed for the transportation of construction workers, and it would therefore be desirable to have a solution allowing the construction workers to travel safely and quickly as high up in the building as possible after each new floor has been completed. The elevators are thus required to be able to move as high up as possible as construction of the building progresses, and the farther up the elevator can safely provide service, the better. In addition, in tall buildings the lower floors are generally finished and ready for normal use before the higher floors have been completed. In this case, the elevators have to be able to serve the floors already completed in as normal a manner as possible although the higher floors of the building are still under construction.

During the construction time, construction workers and accessories can be transported using separately installed construction elevators to be dismantled after completion of the building, such elevators being installed e.g. on the facade of the building. The problems with these extra elevators include their high cost and the expenses resulting from their installation and dismantling. A further problem is that construction elevators like this can not be used as normal elevators to serve the lower building floors already completed.

To tackle this problem, a prior-art solution developed for construction-time use of an elevator is the so-called jump-elevator arrangement, wherein the final elevator shafts are completed in pace with the erection of the building and at least some of the elevator shafts are provided with a temporary machine room to which an elevator car is connected. At certain points during the construction, each time when a suitable number of new floors have been completed, a so-called jump-lift is carried out, by removing the temporary elevator machine room to a higher level according to the number of new floors. In this way, the hoisting height of the elevator is increased by this number of floors. At the same time, all the necessary elevator components are extended to a level corresponding to the new hoisting height so as to enable the elevator to provide normal service to the new floor height.

The problems associated with the above construction-time elevator solution include the difficulty of providing support for the temporary machine room and raising both the temporary machine room and all the components required for this hoisting height, such as electric cables, speed limiter ropes, shaft components and other accessories to the next floor height.

In prior-art solutions, the jump-lift of the temporary machine room and other accessories has been carried out by utilizing e.g. the building's own construction hoist. However, in this case there is the problem that the elevator installation work is too much dependent on the use of the construction hoist. During the working hours, the construction hoist is almost all the time lifting goods to different places in the building, so it may very well be impossible to have the construction hoist available for use at the desired time because it is needed in a completely different part of the building at that same moment. Consequently, elevator installation suffers and construction time becomes longer. In many cases, the utilization of the construction hoist has had to be scheduled e.g. in such a way that it is used for jump-lift as seldom as possible, only after e.g. every five new floors completed. In this case, however, there is the additional problem that the topmost building floors just completed have to remain without elevator service for a long time until a jump-lift can again be carried out.

To overcome the above problem, solutions have been developed wherein the construction hoist is not needed and the temporary machine room is hoisted upwards by using a hoisting arrangement provided in the elevator shaft. A prior-art solution for installing a construction-time elevator without using the construction hoist is disclosed in international patent specification WO00/07923. In this solution, no external construction hoist is utilized at all. Instead, a machine platform supporting the elevator hoisting motor is used. The machine platform functions as a temporary machine room and is lifted one level at a time from a thrust platform below the machine platform by using lifting cylinders or equivalent. However, the solution according to this WO specification involves the problem that both the thrust platform and the machine platform are supported on structures, such as floors, of a building still under construction, i.e. structures that may not yet have been built in the manner required by the final suspension. There is the risk that the total weight of a group consisting of a plurality of elevators may be too big for floors still unfinished. A further problem with the solution according to this WO specification is that it may be necessary to make extra openings in the structures to accommodate installation-time reinforcements. Yet another problem with this solution is that the machine platform can only be lifted one floor-to-floor distance at a time by means of lifting cylinders, so the number of jump-lifts required in a tall building is large and each lifting operation always involves the same additional preparatory arrangements and work, requiring a substantial amount of extra time.

Specifications WO 00/50328 A2 and U.S. Pat. No. 5,033,586 A describe solutions for construction-time use of an elevator. In these solutions, an assembly resembling a machine room and movable in an elevator shaft is raised upwards from time to time according to the progress of construction work.

The object of the present invention is overcome the above-mentioned drawbacks and to achieve a reliable, simple, economical and efficient method and apparatus for installing an elevator without machine room during the construction of a building that will allow faster installation. A further object of the invention is to achieve a method and apparatus for installing an elevator without machine room during the construction of a building that do not require the use of a separate construction hoist as an aid and that are implemented without having a temporary machine room and elevator car supported on the wall or ceiling structures of an unfinished building. Thus, it is an aim to reduce connections dependent on the building being constructed and to install the elevator as independently as possible. An additional object is to maximize the number of floors served with the progress of the construction work as quickly as possible after new floors have been completed. It is also an object of the invention to achieve an apparatus that is largely reusable and is applicable for use in conjunction with many different building constructions and elevators. The method of the invention is characterized by what is disclosed in the characterizing part of claim 1, and the apparatus of the invention is characterized by what is disclosed in the characterizing part of claim 6. The features characteristic of the use according to the invention are disclosed in claim 14. Other embodiments of the invention are correspondingly characterized by what is disclosed in the other claims.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Similarly, within the framework of the basic concept of the invention, different features presented in connection with each example embodiment of the invention can be applied in conjunction with other embodiment examples. For example, the use according to the invention may additionally include the feature that, in the machine room movable in construction-time use, the hoisting machine is used to move the elevator car between completed floors of the building as the construction work is progressing, and/or that in construction-time use the elevator car is moved below the temporary machine room to places not located at the height of completed floors.

The temporary machine room used in the invention may be a greatly simplified structure, even just a beam-construction platform arranged to move in an elevator shaft and used to support the elevator hoisting machine and at least part of the control and electric operating equipment of the elevator. The machine room preferably has a continuous floor structure in at least part of the machine room area. The machine room preferably has wall or railing structures on at least one or more sides. To provide access to the machine room, such a wall or railing structure may be provided with a gate or door. The machine room may also comprise a ceiling, which may cover the machine room area either completely or only partly. Besides the elevator hoisting machine and elevator control and/or electric operating equipment, the temporary machine room may be used to accommodate even other equipment, e.g. a speed limiter monitoring the movement of the elevator, ventilation equipment for ventilating the machine room, equipment for moving the temporary machine room during a jump-lift and for securing it in place for the periods of time between jump-lifts.

A preferable way of building a machine room that can be raised in the elevator shaft is to secure to the beam structure supporting the hoisting machine a floor surface made from one or more plate members, utilize the walls of the elevator shaft as machine room walls and provide the machine room with a ceiling supported so as to allow it to be moved together with the beam structure supporting the hoisting machine and the floor surface secured to it. As a machine room door, it is possible to use a door supported by the machine room floor and placed directly opposite to the landing door opening of the elevator shaft or a door placed in the landing door opening. When the door of the temporary machine room is placed in the landing door opening, the door has to be provided with at least a separate locking arrangement so as to allow controlled opening of the door.

The solution of the invention has the advantage of providing a simple and economical method and apparatus that will allow fast installation. By applying the invention, one or more the following advantages can be achieved, for example:

- elevator installation is independent of the use of the construction hoist and thus it does not cause any disturbance to the rest of the construction activity while allowing easy scheduling
- the temporary machine room and all the required equipment are lifted using a separate lifting arrangement developed for the elevator
- substantially all or at least part of the weight of the temporary machine room, elevator car and counterweight can be supported by the elevator guide rails from the start of installation
- the elevator structures produce no substantial loads on the walls of the elevator shaft being constructed or on the building floors
- elevator installation produces no extra loads on the walls and intermediate floor slabs of the building
- no extra openings and reinforcements for elevator installation need to be made in the concrete structures of the building
- in construction-time use, the speed of an individual lifting operation is greater than when conventional construction hoists are used
- installation of the elevator can be started at a very early stage of construction
- elevator installation progresses fast with the progress of construction, and thus access to the upper floors is quickly provided and normal elevator service to the finished lower floors can be started soon after their completion
- saves the constructors' time, thereby contributing towards faster completion of the building project
- the hoisting machine can be easily and quickly mounted in its final place without re-roping
- safe installation environment and secure anchorage of the temporary machine room in conjunction with a jump-lift
- large suspension ratio of jump-lift allows reliable and safe lifting as well as the use of a moderately sized hoist in conjunction with the jump-lift
- less space is needed outside the building
- the facade of the building can be finished earlier than normal
- solution without machine room saves the costs of an actual machine room.

Figure 2:
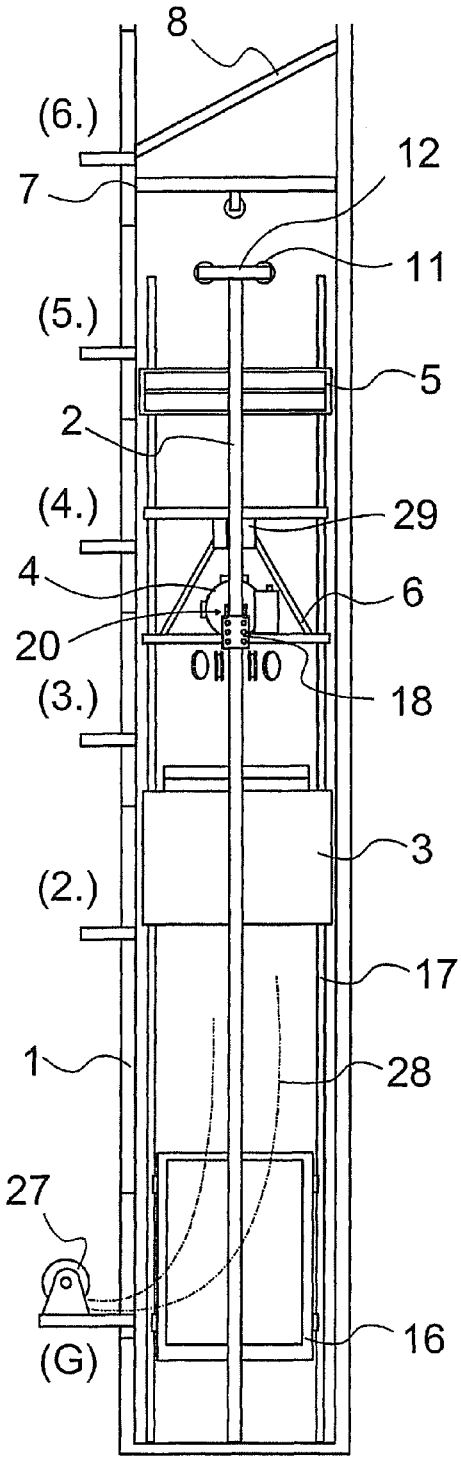
Figure 3:
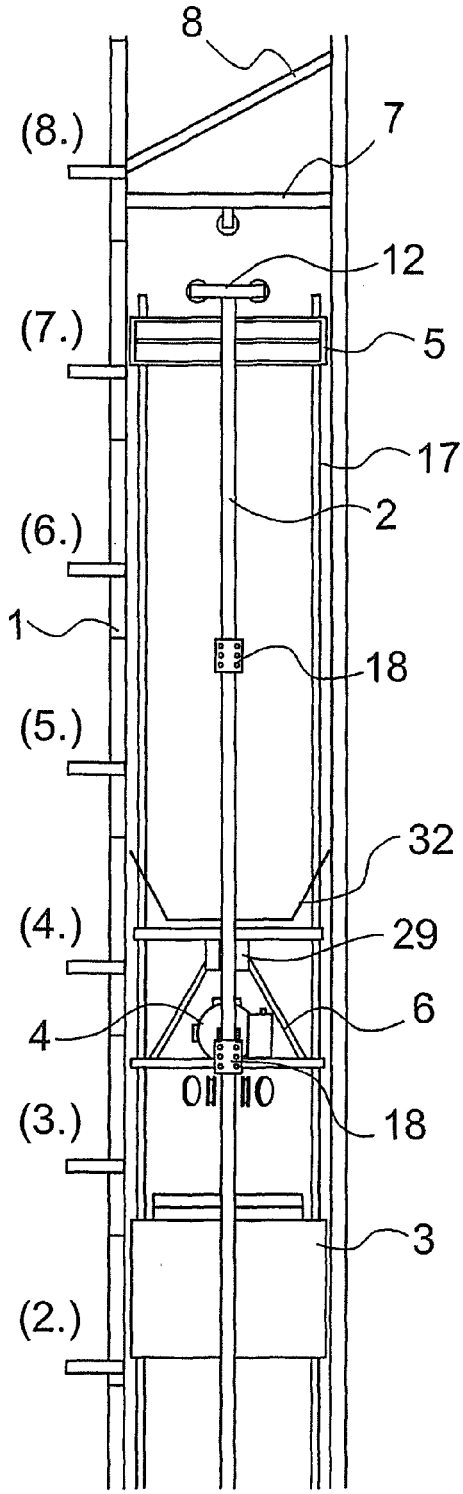
Figure 4:
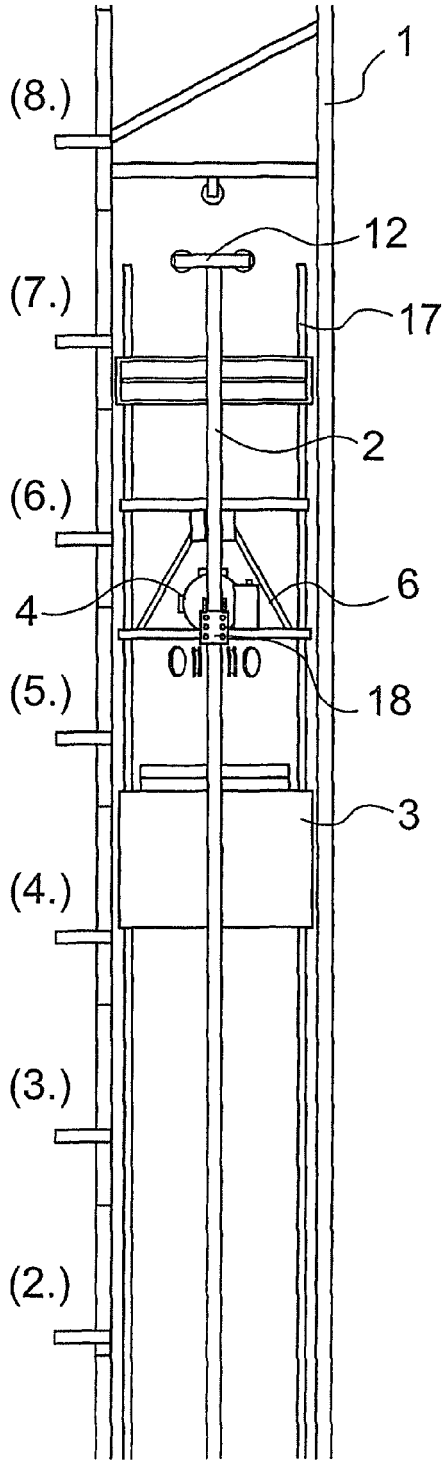
Figure 5:
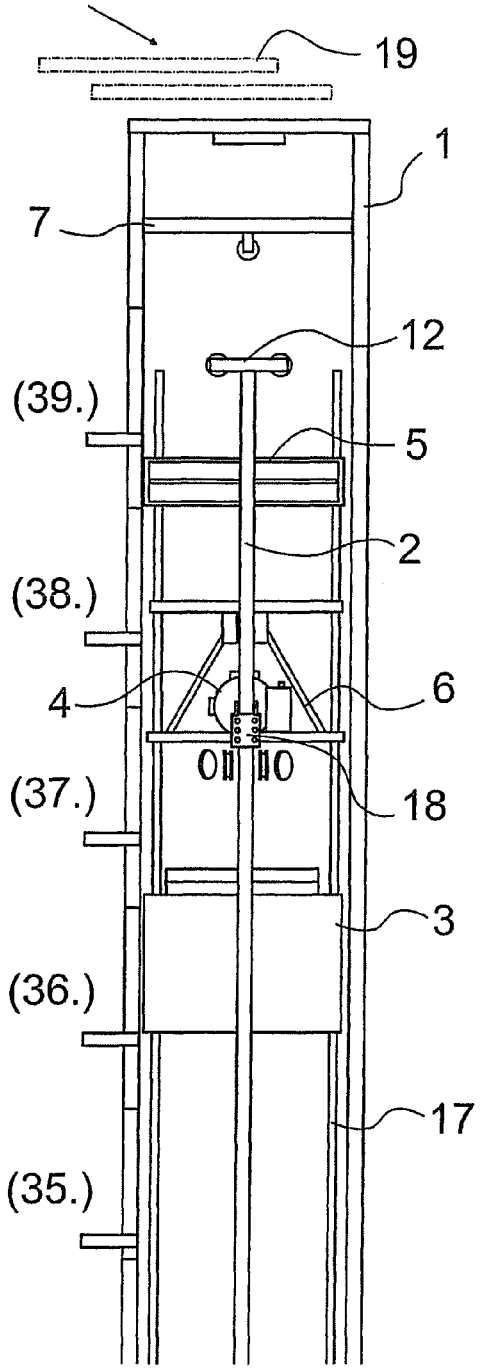
Figure 10:
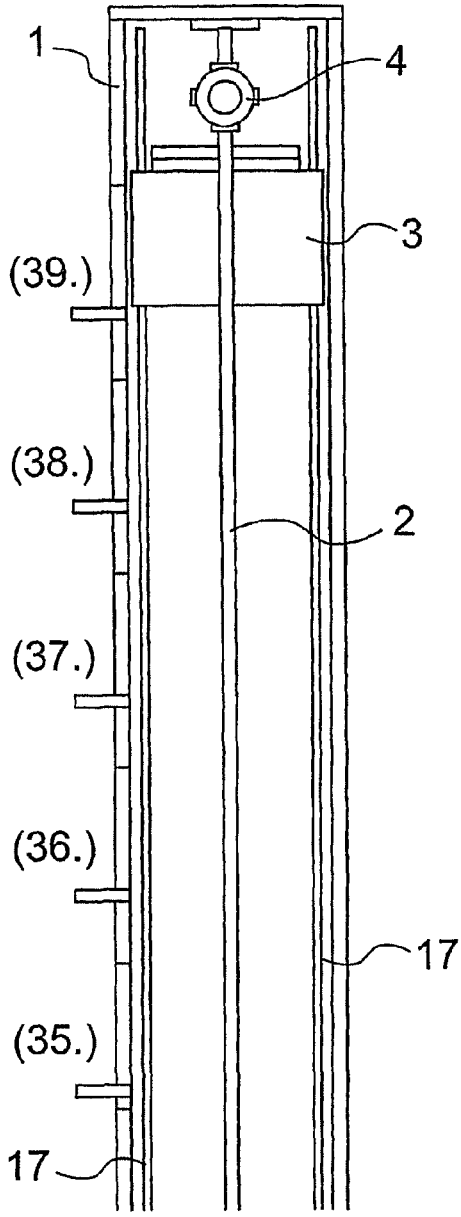
Figure 11:
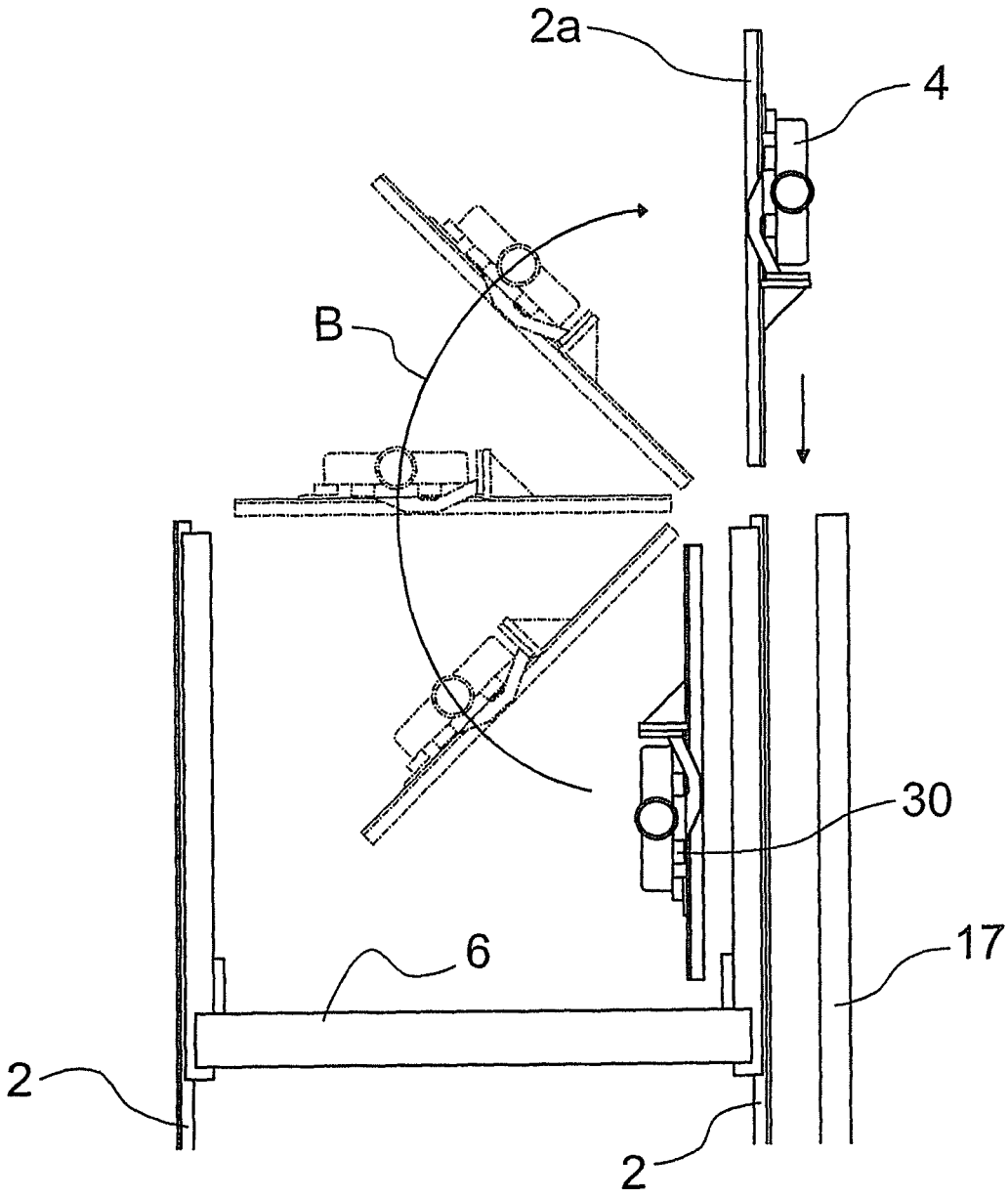
Figure 12:
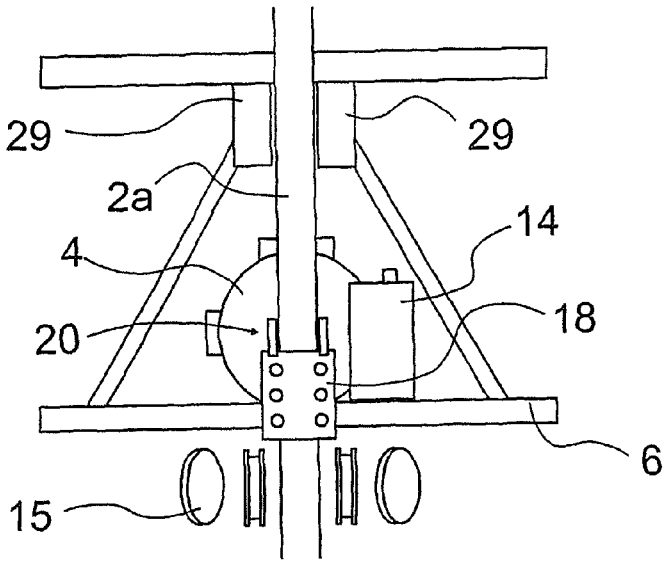
Figure 13:
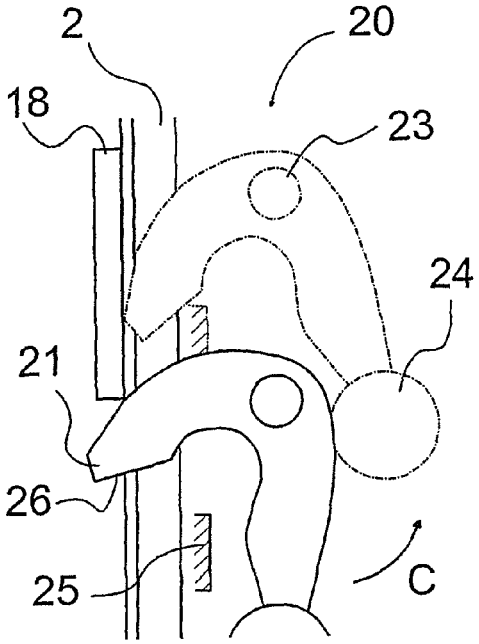
Figure 14:
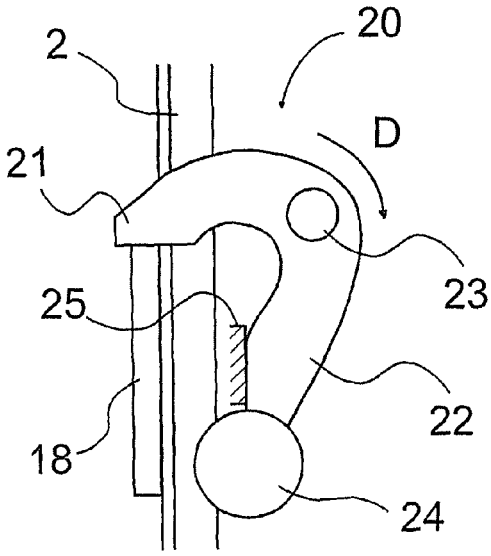

In the following, the invention will be described in detail by referring to an example and the attached drawings, wherein FIG. 1 is a simplified and diagrammatic side view of an elevator installation situation according to the invention where an elevator car has already been installed in an elevator shaft, FIG. 2 is a simplified and diagrammatic side view of an elevator installation situation according to the invention where a first jump-lift has been carried out, FIG. 3 is a simplified and diagrammatic side view of an elevator installation situation according to the invention where preparations are being made for a second jump-lift, FIG. 4 is a simplified and diagrammatic side view of an elevator installation situation according to the invention where the second jump-lift has been carried out, FIG. 5 is a simplified and diagrammatic side view of an elevator installation situation according to the invention where a last jump-lift has been carried out, FIGS. 6-(9) are simplified and diagrammatic side views of elevator installation situations according to the invention at the upper end of the elevator shaft at the final stage of the installation process, FIG. 10 is a simplified and diagrammatic side view of a completely installed elevator according to the invention, FIG. 11 is a simplified and diagrammatic front view of how the hoisting machine is mounted in place, FIG. 12 is a simplified and diagrammatic side view of a temporary machine room according to the invention, FIG. 13 is a simplified, diagrammatic and magnified side view of the locking mechanism of the temporary machine room when the machine room is moving upwards, and FIG. 14 is a simplified, diagrammatic and magnified side view of the locking mechanism of the temporary machine room when the machine room is locked in place.

In the following, an apparatus and an installation method according to the invention will be described by considering their main aspects. FIG. 1 illustrates a method according to the invention for installing an elevator in a situation where a working platform 5, a temporary machine room 6 and an elevator car 3 have already been installed in an elevator shaft 1.

Before the situation represented by FIG. 1, a protective cover 8 has been placed at a suitable height in the upper end of the shaft 1 to provide protection against falling objects and weather, and a hoisting support 7 has been secured to the building structures below the cover. The hoisting support 7 is the only structure used in the elevator installation that is supported on the wall or intermediate floor structures of the building. There may also be more than one protective cover 8 mounted in the shaft by the constructor of the building. In this case, there may be e.g. two protective covers placed one above the other at a vertical distance from each other. The installation-time working platform 5 placed in the shaft 1 and movable substantially independently in the vertical direction is suspended on the hoisting support 7 by the aid of e.g. a Tirak hoist, a hoisting rope 10 and a diverting pulley 9 provided on the hoisting support 7. In addition, the hoisting support 7 may carry a separate goods hoist 31. The working platform 5 is relatively light, so it does not cause too much stress on the intermediate floor and wall structures of the building. By using the working platform 5, the lower parts of the elevator guide rails 2 as well as the counterweight guide rails 17 have been installed in the shaft 1, and these guide rails 2 and 17 are extended to a suitable height below the hoisting support 7. In addition to the guide rails, substantially all the components and devices, such as e.g. the electric equipment and landing doors, needed in the shaft and at the landings are installed at the same time substantially up to the height of the guide rails.

Once a sufficiently high level has been reached in the installation process, a counterweight frame 16 is mounted in the elevator shaft 1 and a temporary machine room 6 is built in the shaft 1. The temporary machine room 6 is of a design allowing easy assembly, disassembly after installation and reuse at a new installation site. It comprises at least a frame structure which is provided with guides fitted to move along the elevator guide rails 2 in the same way as the guides of the elevator car. In addition, the temporary machine room 6 is provided with a safety gear which works substantially in the same way as the safety gear of the elevator car and in an emergency situation prevents the machine room from falling too far downwards. The temporary machine room 6 also carries an elevator hoisting machine 4 including at least a traction sheave 30, a diverting pulley 29 and a control unit. The hoisting machine 4 is secured in a manner corresponding to the final mounting to a short length of guide rail 2*a* supported on the structures of the temporary machine room, as is more clearly shown e.g. in FIG. 11. Moreover, the hoisting machine 4 is turned upside down and horizontally into a reversed position relative to its normal operating position. Thus, the hoisting machine 4 is turned through 180° in both vertical and horizontal planes relative to its final operating position. The temporary machine room 6 is further provided with at least diverting pulleys 15 and a machine room hoisting device, such as a Tirak hoist 14, which is secured to the frame structure of the temporary machine room 6 and serves to suspend the machine room on a hoisting rope 13 and to move it in the vertical direction. The hoisting rope 13 is fitted to run from the Tirak hoist 14 over diverting pulleys 11 placed e.g. at the ends of supporting members 12 mounted on the upper ends of the guide rails 2 and then down around the diverting pulleys 15 below the machine room and after these back to the Tirak hoist 14, the hoisting rope 13 thus forming a closed loop. In this way, the vertical forces produced by the temporary machine room 6 and the elevator car 3 are transmitted to the bottom structures of the building substantially via the guide rails 2 already secured. In the solution according to the example, the suspension ratio of the temporary machine room 6 is 8:1, so the machine room moves slowly and safely when being lifted. Constructed like this, the temporary machine room 6 is self-lifting. The temporary machine room 6 is additionally provided with a locking mechanism 20 adapted to get locked on a locking plate 18, which is fastened to the guide rail 2 at a suitable height when a jump-lift is to be carried out. The locking of the temporary machine room 6 and the structure and operation of the locking mechanism 20 will be described in greater detail in connection with FIGS. 12-14.

After the temporary machine room 6 has been mounted in place, it is lifted by means of the Tirak hoist 14 to a higher position and the elevator car 3 is installed below it in the shaft 1 and secured to the temporary machine room 6 at a suitable vertical distance below the machine room 6. At the same time, the hoisting machine 4 and the elevator car 3 are roped with the final hoisting ropes 28, which are delivered from reels 27 placed on the ground level or on some other suitable level, e.g. as shown in FIG. 2. The hoisting ropes 28 are passed via rope locking devices provided in the temporary machine room 6 to a first diverting pulley 29 placed in the machine room 6 above the traction sheave 30 of the hoisting machine 4, and having passed around this diverting pulley by its upper side, to the traction sheave 4 of the hoisting machine 4. Having passed around the traction sheave by its lower side, the hoisting ropes are passed further upwards to a second diverting pulley 29, around which the hoisting ropes run by the upper side. For the time it takes to carry out the jump-lift, the hoisting ropes 28 are locked by means of the rope locking devices to the temporary machine room 6, which has been adapted to pull a new length of hoisting ropes together with it as it moves upwards.

After these preliminaries, a first jump-lift can be carried out to bring the temporary machine room to a completed floor at as high a level as possible. In the case according to the example, the temporary machine room is jump-lifted to the second floor. Except for the ground floor, the floors are denoted in the figure by dotted numbers in brackets. Before the jump-lift, the locking plate 18 is secured in place to the guide rail 2 at the height of the new floor level and the working platform 5 movable independently relative to the temporary machine room 6 is raised as far up as possible. The jump-lift is carried out using the Tirak hoist 14 by raising the assembly of temporary machine room 6 and elevator car 3 and at the same time the hoisting ropes 28 on reels as well as other cables and ropes that may be required to a height sufficient for the locking mechanism 20 in the temporary machine room 6 to rise above the locking plate 18 secured beforehand in place to the guide rail 2 and lock the machine room 6 to the locking plate. In this situation, the elevator car 3 below is suitably at the desired floor level, in this case at floor two. Once the temporary machine room 6 has been locked in place, the elevator car 3 is released from the temporary machine room 6, whereupon the elevator is free to work in the normal manner, supported by its hoisting ropes 28.

After this, the installation process continues substantially in the same way in pace with the completion of construction of new floors. For example, a jump-lift can be carried out each weekend if a suitable number of floors are completed during the week. The protective cover or protective covers 8 and the hoisting support 7 are hoisted upwards and the working platform 5 is moved in the vertical direction above the temporary machine room 6 in conjunction with the tasks required for the installation. Utilizing the working platform 5, the supporting members 12 are removed from the upper ends of the guide rails 2 already secured, new guide rails are mounted on the top of the existing ones, the supporting members 12 are secured to the upper end of the new guide rails and the hoisting rope 13 is mounted in place over the diverting pulleys 11, and the locking plate 18 is secured in position to the new guide rail 2. In addition, the components and devices required for the new floors are installed at the same time in the shaft and at the landings by utilizing the working platform 5 as in the case of the lower floors. FIGS. 3 and 4 visualize the next jump-lift, whereby the temporary machine room 6 and the elevator car 3 are lifted to a height such that elevator service can be provided up to the fourth floor. FIG. 3 also shows an extra shield 32 placed over the temporary machine room 6. It may be composed of e.g. metal plates that can be turned in a suitable manner to a protecting position.

Figure 6:
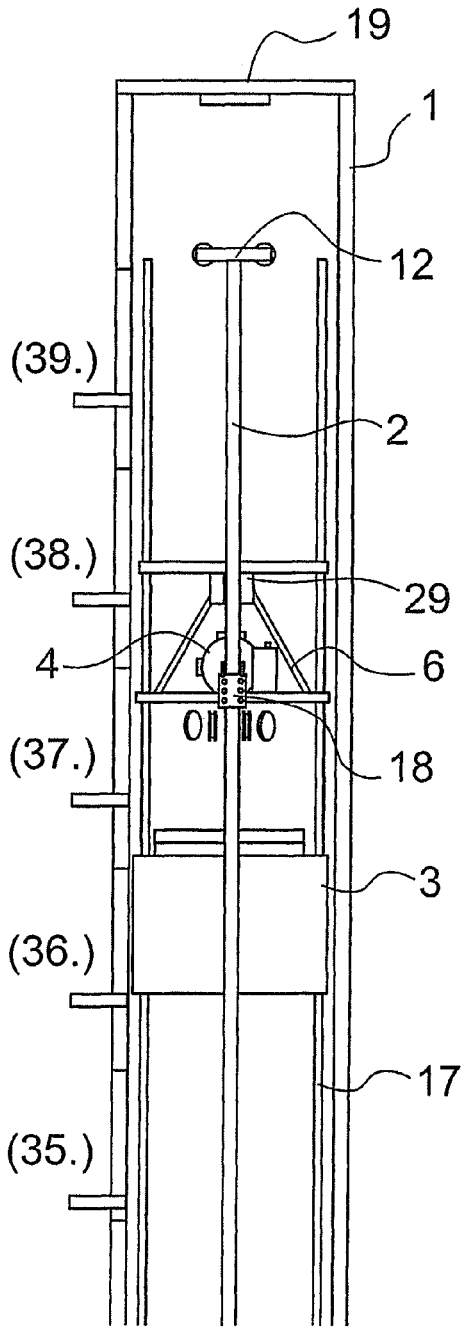

FIGS. 5 and 6 illustrates the installation in a situation where a sufficient number of jump-lifts have been carried out to reach the height of the final four topmost floors. The protective cover 8 is now removed and a final ceiling 19 is mounted on the shaft. As shown in FIG. 6, short guide rails adapted to the final building height are mounted as extensions of the previous guide rails 2 and 17. At the same time, any items of equipment that may still be missing from the shaft and landings are installed, whereupon the hoisting support 7 and working platform 5 are removed.

Figure 7:
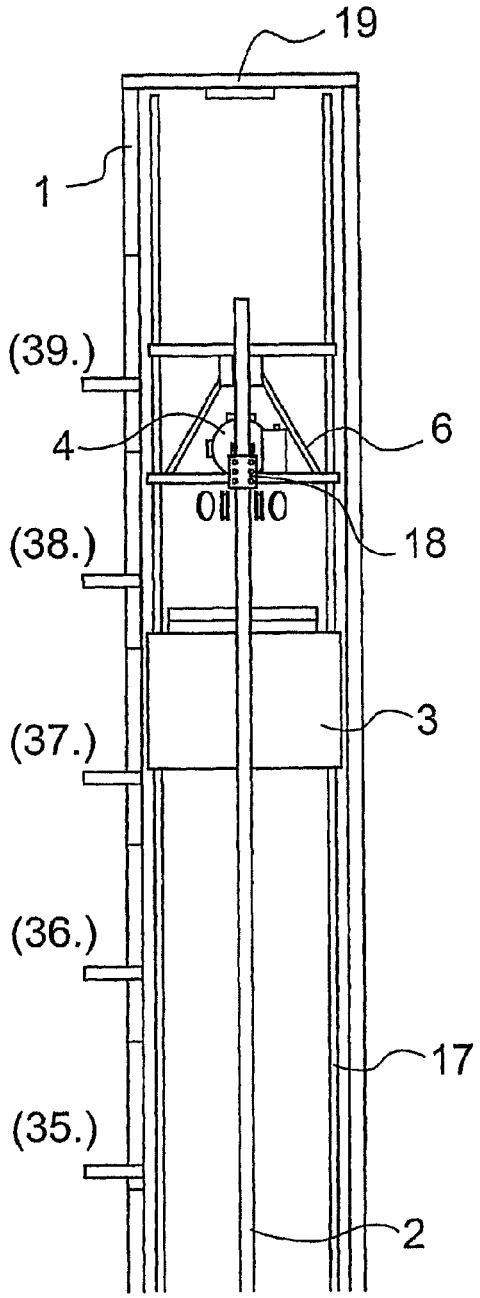
Figure 8:
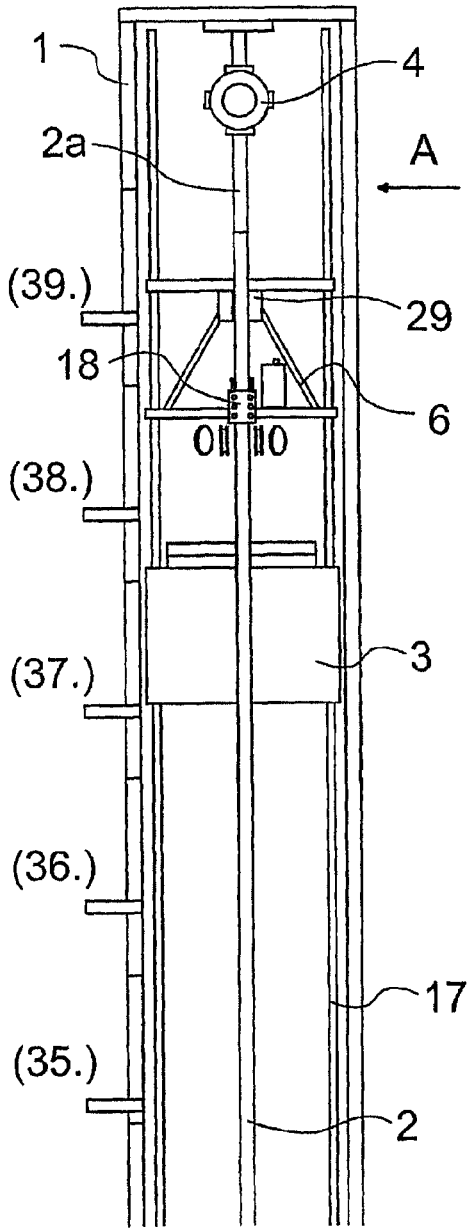

In the situation according to FIGS. 7 and 8, the temporary machine room 6 has been driven and locked to its highest position, and the elevator car 3 has thus been brought to the third-highest floor, i.e. in this case to floor 37. The supporting members 12 are removed and the topmost parts of the guide rails are installed as extensions of the previously mounted guide rails 2, except for the guide rail to which the machine 4 is secured. After this, the machine 4 together with the short guide rail piece **2*a* is released from the temporary machine room 6 and turned around through 180°, i.e. into an upturned position relative to the position in which the machine 4 was in the temporary machine room 6. Turned in this way, the short guide rail piece 2*a* is fixed as an extension to the upper end of the guide rail 2 which has already been mounted in the elevator shaft 1 in conjunction with the installation and which is still free, in such a way that, relative to the elevator car 3, the machine 4 remains behind the guide rail. The machine 4 is turned around in a vertical plane and, more precisely speaking, substantially in the plane of rotation of the diverting pulleys 29; the hoisting ropes now readily turn with the machine 4 off the diverting pulleys 29 and the roping is ready immediately after the turning operation. After this turning, the diverting pulleys 29 are superfluous and can be removed. The plane of rotation of the diverting pulleys 29 in FIGS. 1-8 is substantially perpendicular to the plane of the paper, so the axle of the diverting pulleys 29 extends in a direction substantially coincident with the plane of the paper. This solution provides the advantage that no re-roping is required in this connection. FIG. 11 presents a more detailed illustration of how the hoisting machine 4** is turned to its final position.

Figure 9:
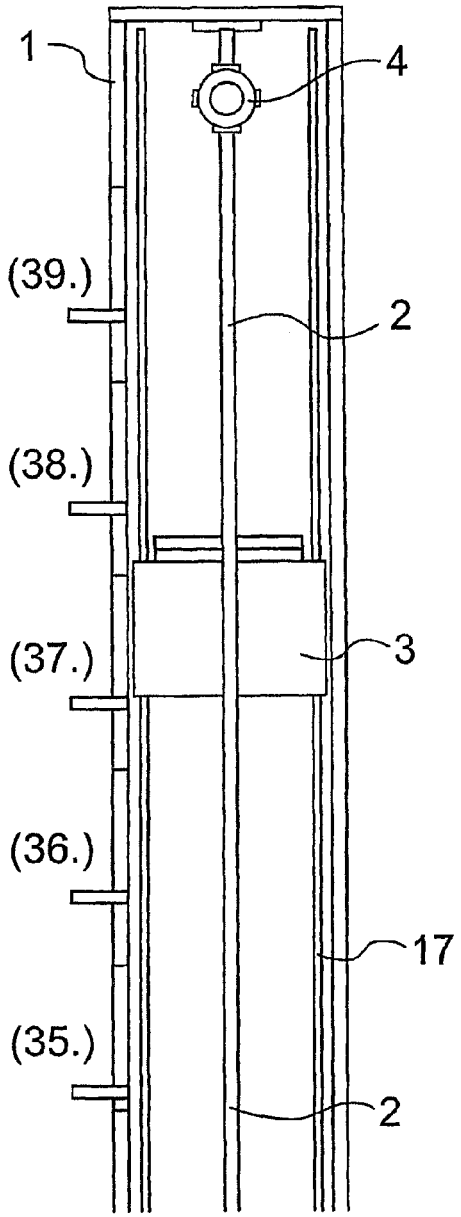

FIGS. 9 and 10 illustrate the next step. The temporary machine room 6 is dismounted e.g. via the topmost floor and the elevator car 3 is hoisted to the top floor e.g. by using the Tirak hoist. After this, any extra length that may remain in the hoisting ropes is removed, the Tirak hoist is released and the elevator is set free for normal operation.

FIGS. 12-14 present a diagrammatic and simplified illustration of the structure and operation of the locking mechanism of the temporary machine room 6. The locking mechanism 20 is automatic and functions e.g. by gravity. This mechanism 20 comprises a two-arm hook-like locking lever 22 provided with a weight element at its lower end and hinged by its upper part on a pivot shaft 23 in the frame structure of the temporary machine room 6. The arms of the locking lever 22 form an angle between themselves substantially in the area of the hinge 23. In addition, the upper arm 21 has on its lower surface a stop face 26 adapted to engage the upper edge of the locking plate 18 when the temporary machine room 6 is to be locked to its new position e.g. after a jump-lift. Furthermore, the frame structure of the temporary machine room 6 is provided with a fixed back stop 25 fitted to back up the lower lever arm of the locking lever 22 during the locking function. The locking mechanism 20 and locking plate 18 are so dimensioned relative to each other that the weight element 24, placed on the other side of the hinge 23 relative to the stop face 26, is adapted to keep the stop face 26 in a position such that, when the locking mechanism 20 is in a disengaged stage, the stop face 26 extends over the upper edge of the locking plate 18 somewhat outside the temporary machine room 6.

The operation of the locking function is such that, during the lifting of the temporary machine room 6, the locking lever 22 is in the lower position depicted in FIG. 13 with solid line. The weight element 24 is down and has thus brought the locking lever 22 freely supported by the hinge 23 into a balanced position. When the temporary machine room 6 is being lifted upwards, the beveled upper surface of the upper arm 21 of the locking lever 22 meets the lower edge of the locking plate 18, with the result that the locking lever 22 turns in the direction indicated by arrow C about the hinge 23 against the force produced by the weight element 24, until the upper arm 21 of the locking lever 22 can slide upwards along the inner surface of the locking plate 18. When the upper arm 21 of the locking lever 22 moves past the locking plate 18 and rises far enough above its upper edge, the weight element 24 turns the locking lever 22 in the direction of arrow D into the locking position shown in FIG. 14, in which the stop face 26 of the upper arm 21 of the locking lever 22 meets the upper edge of the locking plate 18 and the temporary machine room 6 is automatically locked in place. The supporting force of the locking plate 18 still tends to lift the upper arm 21 of the locking lever and to turn the locking plate about the hinge 23 in the direction of arrow D, but the back stop 25 prevents this motion and the locking lever remains safely in its locking position.

It is obvious to a person skilled in the art that different embodiments of the invention are not exclusively limited to the examples described above, but that they may be varied within the scope of the claims presented below. Thus, for example, the structure and suspension of the temporary machine room may vary from the above description. The suspension ratio, instead of an 8:1 ratio as mentioned, may be 1:1, 2:1, 4:1 or some other suitable suspension ratio. Likewise, as to its construction, the temporary machine room may have a frame structure with a floor and ceiling secured to it while the elevator shaft walls form the walls of the temporary machine room. The temporary machine room may also be so constructed that, in addition to a frame structure, floor and ceiling, it also has its own side walls and a door. In another alternative, the temporary machine room may be so constructed that it has a frame structure and a floor while the ceiling consists of a suitably equipped working platform above the temporary machine room and the elevator shaft walls serve as the walls of the temporary machine room.

It is also obvious to a person skilled in the art that the number of floors covered by the jump-lift is not limited to the above-mentioned two floors but may instead be any number of floors, e.g. 1, 3, 4, 5, 6 or even more.

It is further obvious to a skilled person that the hoisting machine used may also be a machine type other than a so-called flat machine which is mounted on a guide rail of the elevator car. The machine may just as well be a machine provided with a traditional motor, and the machine may be mounted in a different place in the shaft and in a different manner than in the above description.

A person skilled in the art understands that, instead of a Tirak hoist, it is also possible to use some other hoist applicable or to use several hoists. Likewise, the skilled person understands that, instead of by using a hoist or hoists, the temporary machine room and/or the working platform may be moved in the elevator shaft by some other applicable method.

Furthermore, it is obvious to a person skilled in the art that the hoisting machine may be turned at the final stage of installation through an angle other than 180 degrees and in a different plane than in the above description. Thus, the hoisting machine may be turned e.g. in the plane of rotation of the traction sheave through 0-180 degrees. Zero degrees here means that the traction sheave is already oriented the right way, so it need not be turned in the direction of the plane of rotation of the traction sheave at all but can be moved to its proper place without being turned.

It is additionally also obvious to a person skilled in the art that the locking mechanism of the temporary machine room may be of a different type than that described above. The locking mechanism may be e.g. a spring-operated or pneumatic mechanism or a mechanism operated on another appropriate principle. Moreover, instead of a single locking mechanism, it is also possible to use two locking mechanisms, in which case a separate locking mechanism is provided on either side of the machine room.

It is further obvious to a skilled person that the various steps of the method of the invention may differ from those described above and that they may be carried out in a different order.

The invention claimed is:

1. A method for installing an elevator without machine room during the construction of a building, said elevator comprising at least a hoisting machine provided with a traction sheave and an elevator car suspended by a set of hoisting ropes and fitted to move along guide rails said method comprising the steps of:

utilizing at least a temporary machine room movable in the elevator shaft;

turning the hoisting machine from a position in the temporary machine room upside down into a mounting position that is located outside of the temporary machine room but is located in the elevator shaft, and securing the hoisting machine to the mounting position; and at the final stage of installation, dismounting the temporary machine room from the elevator shaft after the hoisting machine is turned upside down and secured to the mounting position, thereby converting the elevator into the elevator without machine room.

2. The method according to claim 1, further comprising the steps of:

placing the hoisting machine into the mounting position in the elevator shaft by releasing the hoisting machine together with the traction sheave from the temporary machine room; and moving the hoisting machine together with the hoisting ropes on the traction sheave into the mounting position.

3. The method according to claim 2, further comprising the step of turning the hoisting machine into the mounting position together with a guide rail piece fastened to the hoisting machine, the guide rail piece being secured to the upper end of a guide rail already mounted in the elevator shaft in conjunction with the installation.

4. The method according to claim 2, further comprising the step of performing the installation utilizing a temporary working platform movable in the elevator shaft in a substantially vertical direction, the working platform being equipped to also function as the ceiling of the temporary machine room.

5. The method according to claim 1, wherein the step of turning the hoisting machine upside down includes turning the traction sheave that was used in the temporary machine room upside down into the mounting position in the elevator shaft.

6. The method according to claim 5, further comprising the step of turning the hoisting machine into the mounting position together with a guide rail piece fastened to the hoisting machine, the guide rail piece being secured to the upper end of a guide rail already mounted in the elevator shaft in conjunction with the installation.

7. The method according to claim 5, further comprising the step of performing the installation utilizing a temporary working platform movable in the elevator shaft in a substantially vertical direction, the working platform being equipped to also function as the ceiling of the temporary machine room.

8. The method according to claim 1, further comprising the step of performing the installation utilizing a temporary working platform movable in the elevator shaft in a substantially vertical direction, the working platform being equipped to also function as the ceiling of the temporary machine room.

9. A method for installing an elevator without machine room during the construction of a building, said elevator comprising at least a hoisting machine provided with a traction sheave, a guide rail piece fastened to the hoisting machine, and an elevator car suspended by a set of hoisting ropes and fitted to move along a guide rail, said method comprising the steps of:

utilizing at least a temporary machine room movable in the elevator shaft;

turning the hoisting machine together with the guide rail piece from a position in the temporary machine room upside down into a mounting position that is located outside of the temporary machine room but is located in the elevator shaft, and securing the hoisting machine to the mounting position and securing the guide rail piece to the upper end of the guide rail already mounted in the elevator shaft in conjunction with the installation; and at the final stage of installation, dismounting the temporary machine room from the elevator shaft after the hoisting machine is turned upside down and secured to the mounting position, thereby converting the elevator into the elevator without machine room.

10. The method according to claim 9, further comprising the step of performing the installation utilizing a temporary working platform movable in the elevator shaft in a substantially vertical direction, the working platform being equipped to also function as the ceiling of the temporary machine room.

11. An apparatus for installing an elevator without machine room during the construction of a building, said elevator comprising at least a hoisting machine provided with a traction sheave and an elevator car suspended by a set of hoisting ropes and fitted to move in an elevator shaft along guide rails, and said apparatus comprising:

at least a temporary machine room movable in the elevator shaft, said temporary machine room being supported on the guide rails during the installation period, wherein the hoisting machine is mounted for the installation period in the temporary machine room, where the hoisting machine is so placed and roped with the hoisting ropes that, at the final stage of installation, the hoisting machine together with the hoisting ropes on the traction sheave can be moved to a final mounting position in the elevator shaft, wherein the hoisting machine is turned from a position in the temporary machine room upside down to the final mounting position that is located outside of the temporary machine room but is located in the elevator shaft and is secured to the final mounting position located outside of the temporary machine room, and wherein at the final stage of installation the temporary machine room is dismounted from the elevator shaft after the hoisting machine is turned upside down and secured to the final mounting position, thereby converting the elevator into the elevator without machine room.

12. The apparatus according to claim 11, wherein the hoisting machine is secured to the temporary machine room together with a guide rail piece in such manner that the securement of the hoisting machine to the guide rail piece is substantially the final securement consistent with the operating position, and wherein the traction sheave is directly mounted on the guide rail piece.

13. The apparatus according to claim 11, wherein the temporary machine room is provided with diverting pulleys placed substantially above the traction sheave of the hoisting machine, the hoisting ropes being fitted to pass around these diverting pulleys by their upper side so that the hoisting ropes pass around the traction sheave in the temporary machine room by lower side thereof.

14. The apparatus according to claim 11, wherein, to allow hoisting of the temporary machine room, the temporary machine room is provided with at least a set of diverting pulleys and a hoisting device, and, at least for the time of a jump-lift, a supporting member provided with two diverting pulleys is placed on the upper end of each elevator car guide rail already installed, and a hoisting rope for lifting the temporary machine room is fitted to form a closed loop over the diverting pulleys and the hoisting device so that the suspension ratio is 8:1.

15. The apparatus according to claim 11, wherein the apparatus comprises a locking mechanism in the temporary machine room and a locking plate to be secured to an elevator guide rail at a height corresponding to the jump-lift to allow the temporary machine room to be locked to at least one elevator guide rail.

16. The apparatus according to claim 15, wherein the locking mechanism comprises at least a stop face adapted to be engaged on the upper edge of the locking plate, a hinge and a weight element on the other side of the hinge, the weight element being adapted to keep the stop face in a position such that, when the locking mechanism is in a disengaged state, the stop face extends over the upper edge of the locking plate.

17. The apparatus according to claim 11, wherein a temporary working platform movable substantially in a vertical direction is placed in the elevator shaft, said working platform being equipped to also function as the ceiling of the temporary machine room.

* * * * *